US005497052A

United States Patent [19]

Buckley, II

[11] Patent Number: 5,497,052

[45] Date of Patent: Mar. 5, 1996

[54] ISOLATED CONSTANT WATTGE LAMP BALLAST

[75] Inventor: Paul J. Buckley, II, Blytheville, Ark.

[73] Assignee: MagneTek, Inc., Paramus, N.J.

[21] Appl. No.: 257,346

[22] Filed: Jun. 9, 1994

[51] Int. Cl.[6] ..... H05B 41/14

[52] U.S. Cl. ..... 315/276; 315/278; 336/148; 336/183

[58] Field of Search ..... 315/276, 277, 315/278, 279, 228, 282, 86, 239, 241 R, DIG. 5, DIG. 7; 336/182, 183, 148

[56] References Cited

U.S. PATENT DOCUMENTS 2,960,624 11/1960 Strecker ..... 315/282
3,089,980 5/1963 Neusbaum ..... 315/278
3,611,026 10/1971 Crawford ..... 315/276
3,771,068 11/1973 Paget et al. ..... 315/276 X
4,101,806 7/1978 Alley ..... 315/86

*Primary Examiner*—Ali Neyzari
*Attorney, Agent, or Firm*—Darby & Darby

[57] ABSTRACT

A constant wattage ballast transformer of the isolated type permitting the electrical grounding of a mounting shell of the lamp it powers in which a primary, secondary and auxiliary winding are provided with the primary winding inducing voltage into the auxiliary and secondary windings while being electrically isolated from both these windings and the auxiliary winding electrically connected to the secondary winding to add its induced voltage to that directly induced in the secondary winding from the primary winding.

16 Claims, 6 Drawing Sheets

ISOLATED CONSTANT WATTGE LAMP BALLAST

BACKGROUND OF THE INVENTION

Ballast transformers for various types of lighting sources are well known. The ballast receives voltage from a supply and provides the operating voltage and current for the light source. A type of light source operated by a ballast is a high intensity discharge (HID) type lamp, such as mercury vapor, metal halide and sodium vapor lamps. In some applications, it is desired that the screw shell of the HID lamp socket, which is electrically connected to the low potential side of the secondary circuit, be electrically grounded.

A common regulating ballast used at the present time for powering HID lamps is of the constant wattage autotransformer (CWA) type, a schematic diagram of which is shown FIG. 1. Here, the ballast transformer 10 includes a primary winding 12 in an autotransformer configuration. The lower portion of the primary winding, as shown, provides a voltage in additive relationship to the secondary winding 14 to produce the final operating voltage supplied through a capacitor 16 to the HID lamp 18. The magnetic portion of the ballast is schematically shown by the laminations 20 which includes a magnetic shunt 22.

The CWA autotransformer type ballast of FIG. 1 does not provide electrical isolation between the primary and secondary windings. Therefore, it is not possible to electrically ground the lamp screw shells of an HID lamp operated by the CWA style ballast shown in FIG. 1 which operates from polyphase voltage supply systems. The CWA ballast of FIG. 1 is used in many applications requiring regulated ballasts without a requirement for grounding of the screw shells.

In applications that require the HID lamp screw shells to be grounded, constant wattage isolated (CWI) and magnetic regulating ballasts are used. Designs of these types of ballasts are shown in FIGS. 2 and 3. As seen in FIG. 2, the primary winding 12 and the single secondary winding 14 are electrically isolated from each other. The ballast of FIG. 3 is of the magnetic regulating type which includes two separate secondary windings 14-1 and 14-2 which are isolated from the primary winding 12. Magnetic shunts 22 and 22-1 associated with the laminations 20 assist in providing regulating features.

Since the ballast designs of FIGS. 2 and 3 have primary and secondary windings which are electrically isolated, they can be used on polyphase power system where an HID lamp mounting shell is to be electrically grounded. However, neither of these designs has the advantage of an autotransformer in which part of the voltage on the primary side is added to the secondary winding side voltage. Without deriving part of the required secondary voltage directly from the primary winding, additional secondary turns are required for the secondary windings in both of these designs to obtain the same output voltage as in an autotransformer design. Accordingly, the ballasts of FIGS. 2 and 3 are bigger, consume more energy, and are substantially more costly than an autotransformer type ballast.

BRIEF DESCRIPTION OF THE INVENTION

The present invention relates to a ballast design which is particularly useful for HID lamps where one or more of its mounting shells is to be electrically grounded. In accordance with the invention, a ballast design similar to the constant wattage autotransformer (CWA) type is provided which includes an auxiliary winding into which a voltage is induced from the primary winding for generation of the cross-over to common (tap) voltage which is to be added to the voltage induced in the secondary winding. The secondary winding is electrically isolated from the primary winding.

OBJECTS OF THE INVENTION

It is therefore an object of the present invention to provide an HID magnetic ballast design that has the performance and benefits similar to CWA ballasts while offering electrical isolation between the primary and the secondary coils.

A further object is to provide a ballast in which the size and energy loss of a ballast is minimized while still providing winding isolation.

Another object is to provide an isolated constant wattage autotransformer ballast.

A further object is to provide a ballast transformer of a constant wattage autotransformer type, particularly for use with high intensity discharge lamps, in which the secondary winding is electrically isolated from the primary winding.

Yet another object is to provide a ballast transformer of the constant wattage autotransformer type which is useful for high intensity discharge lamps having a mounting shell which is to be electrically grounded.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 4:
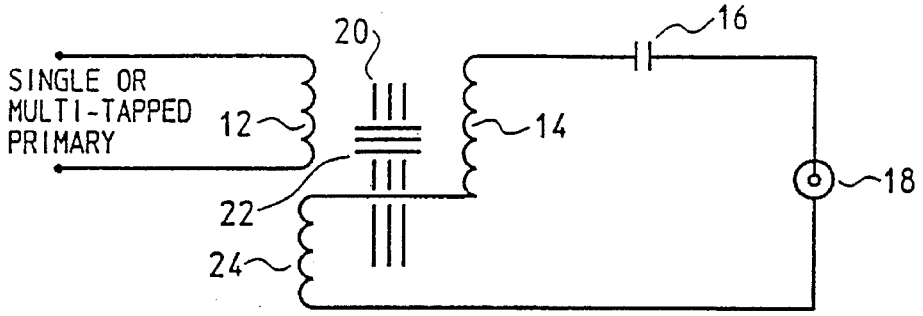
FIGS. 4–10 are schematic diagrams of various forms of ballast in accordance with the invention.
Figure 5:
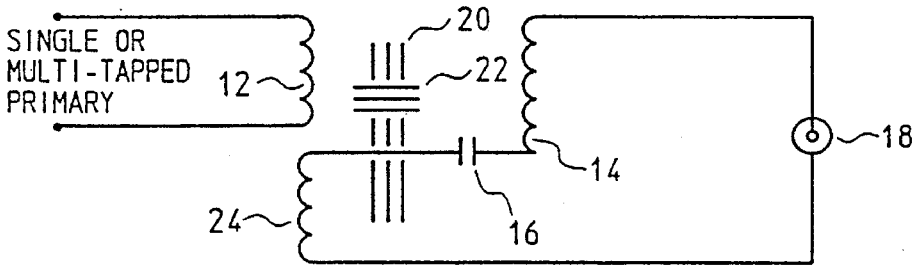
Figure 6:
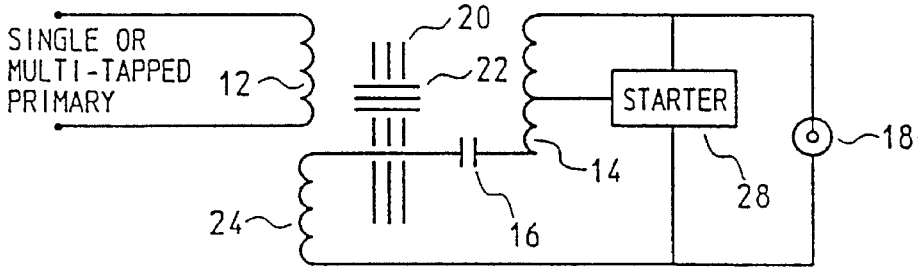
Figure 7:
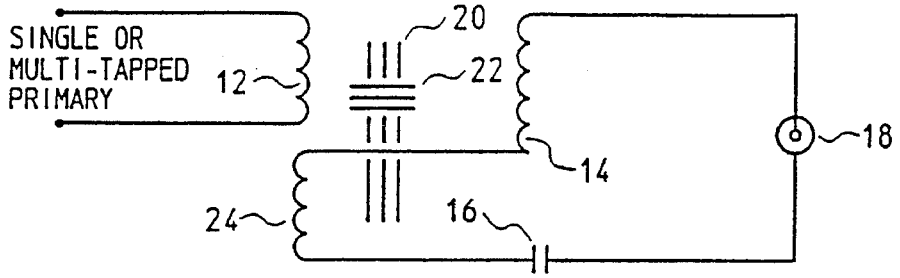
Figure 8:
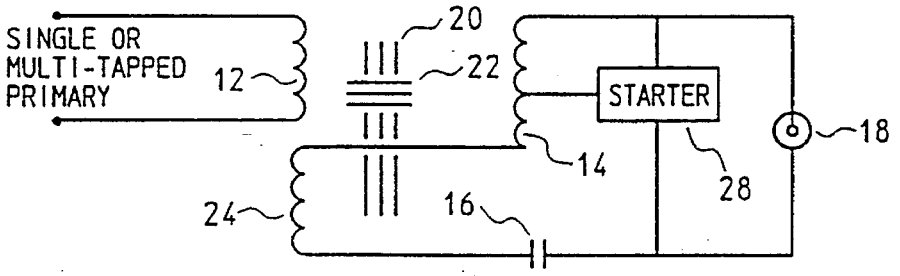
Figure 9:
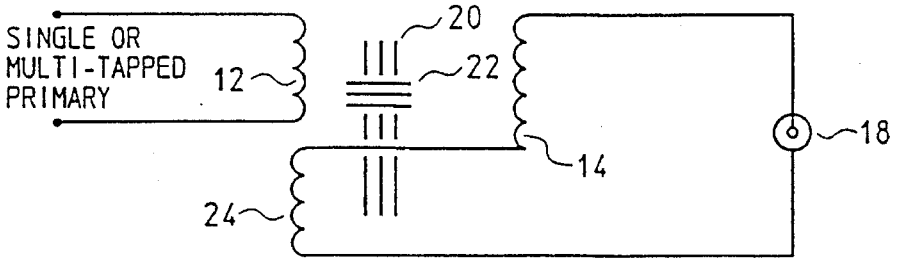
Figure 10:
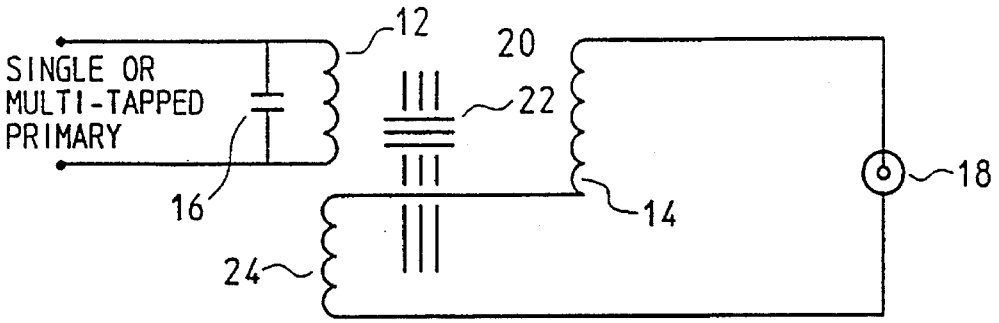

FIG. 4 shows the schematic representation of a ballast in accordance with the present invention. The basic circuit design includes a primary winding 12 which is to be driven from an AC voltage source. This winding, along with the other windings, are either wound around a lamination 20 or are wound in a manner that will facilitate their insertion around a lamination 20 that provides a complete flux path. Common styles presently in use are the core and coil and shell construction schemes available from the use of E&I, U&I, C&C, L&L, and LTL style laminations.

A separate and electrically isolated auxiliary winding 24 is positioned adjacent to, i.e., either along side, on top of, or underneath, the primary winding to establish a voltage induced from the primary winding that will directly aid the secondary winding 14 in establishing the output voltage for driving the lamp 18.

A shunt 22, or set of shunts, depending on the lamination style, is placed between the secondary coil and the other coils to help establish the inductance required for a given lamp power level.

A secondary winding 14 is used in conjunction with the auxiliary winding 24 to establish the open circuit voltage necessary to start the lamp 18. The secondary winding 14 along with the shunts 22, lamination configuration 20, and capacitor 16 are designed to establish the net secondary impedance required to regulate the proper lamp current. One end of the auxiliary winding 24 is electrically connected to an end of the secondary winding 14 to add the voltage induced in the auxiliary winding to that induced in the secondary winding.

FIGS. 5 through 10 show variations of the basic design scheme. It can be seen that this design approach applies to single or multi-tapped primary windings (FIGS. 4–10), ballasts with (FIGS. 6 and 8) or without (FIGS. 4, 5, 7, 9 and 10) a starter 28, ballasts (FIGS. 4-8) with the capacitor 16 placed in various locations, as well as nonregulating ballasts (FIGS. 9 and 10) defined as a ballast that does not use a capacitor in series with the lamp.

Figure 1:
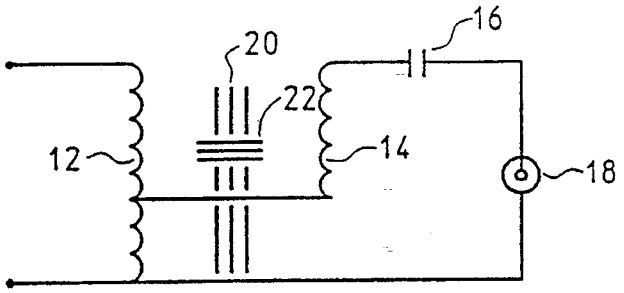
Fig. 1 PRIOR ART
FIGS. 1–3 are schematic representations of prior art ballast designs.
Figure 2:
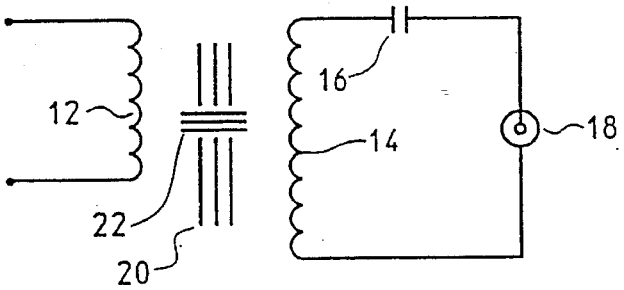
Fig. 2 PRIOR ART

In the existing isolated winding technology for HID ballasts, FIG. 2, the turns ratio coupling coefficient can be as low as 0.6 resulting in the secondary turns being as much as 1.7 times what the classical transformer turns ratio might indicate. The additional number of turns, coupled with the larger gauge of wire required to carry the secondary current, leads to an excessive winding volume requirement when this style design is used compared against the more common constant wattage autotransformer (CWA). The CWA design, e.g., FIG. 1, is significantly smaller than the CWI or magnetic regulating design, e.g., FIGS. 2 and 3, because it utilizes part of the primary winding's voltage to directly supplement the secondary winding's voltage. Utilizing this arrangement, the secondary winding area is downsized considerably while only impacting the primary winding area slightly due to the vectorially added currents.

The present invention derives a number of benefits from maximizing the coupling coefficient on a portion of the voltage generated for the secondary open circuit voltage thus reducing the overall winding volume required for a given design. The same voltage that was directly obtained from the primary coil in a CWA design is now being derived from an auxiliary winding adjacent to, but isolated from, the primary winding. This allows for a near direct (1:1) primary-auxiliary turns ratio relationship. The auxiliary coil 24 is relatively small in size and existing CWA designs, when optimized for space, will typically contain enough space to add this coil without impacting size. The result is an isolated design that remains the same size or close to the same size as the existing CWA design.

In the ballast designs shown, the regulating capacitor 16 can remain the same and the ballast losses can remain the same depending on the wire sizing. In contrast, the equivalent CWI ballast will typically be 15 to 25% larger than the new ballast, consume 3 to 5% more power, and generally will require a different capacitor value. The advantages of reduced size and power consumption are even more significant when compared to magnetic regulating designs, FIG. 3, as these designs are even larger and consume more power than CWI designs.

Figure 11:
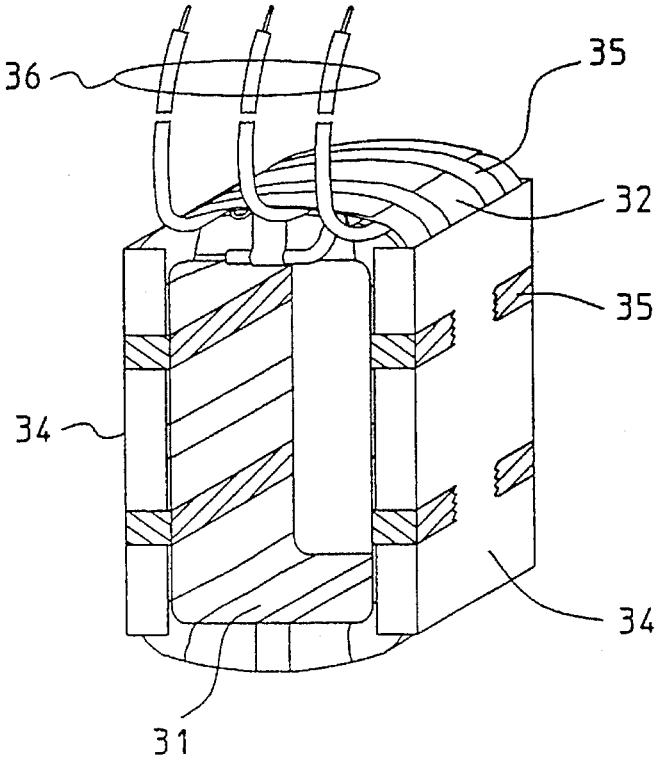
FIG. 11 is a perspective view of a winding which is to be used in the ballast transformer of the invention.
Figure 12:
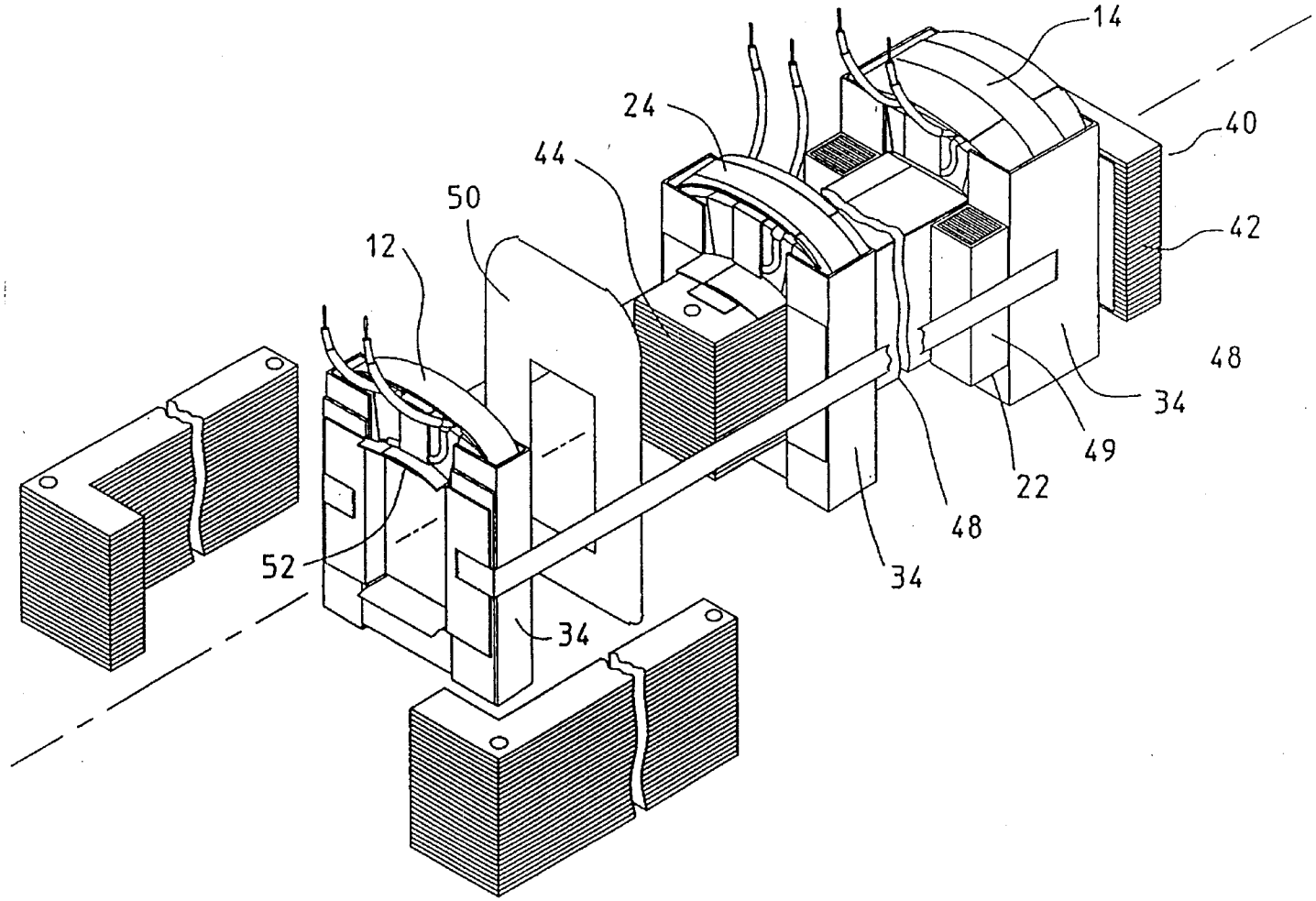
FIG. 12 is a perspective exploded view of the ballast.
Figure 13:
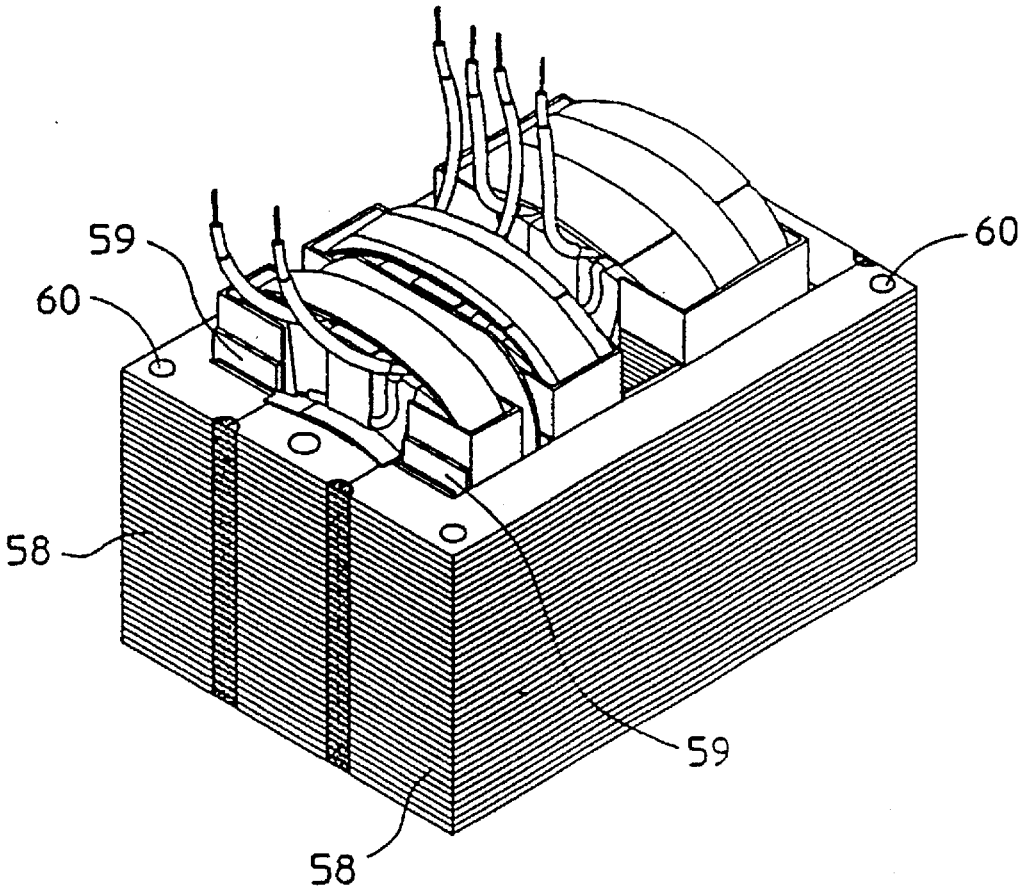
FIG. 13 is a perspective view of the assembled ballast.

FIGS. 11–13 show the details for one type of construction which can be used to form any of the circuits shown in FIGS. 4–10 in accordance with the invention. Of course, as previously explained, other configurations, such as including different types of laminations, can be used.

Each of the primary winding 12, auxiliary winding 24 and secondary winding 14 is of similar construction, except for the number of turns of wire used for the respective winding. A typical configuration is shown in FIG. 11 in which the winding has wound layers of wire separated by insulating paper, the inner and outer layers 31 and 32 of which are shown. Mounted on each of the opposite side walls of the winding is a shoe 34 of a suitable insulating material, such as plastic or paper, which provides additional structural rigidity for the winding. The entire arrangement of the layers of wire and paper, as well as the shoes 34, are held together by a plurality of strips of adhesive backed tape 35 to form a secure structure. A set of leads 36 from the winding are shown. These are electrically connected as needed according to the circuits of FIGS. 4–10.

The ballast includes a central main lamination stack formed by a plurality of T-shaped laminations 40 each with a cross-head 42 and an elongated center arm 44. The center arms 44 form a lamination stack which is generally rectangular in shape.

A first tube 48 of suitable insulating material, for example plastic or paper, corresponding to the outer shape of the stack of T center arm laminations 44 is slid over the center arm stack. Thereafter, the secondary winding 14 is slipped over the tube 48 as is the magnetic shunt 22 and the auxiliary coil 24. The magnetic shunt 22 is mounted on a ring-carrier 49 which is slid over the tube 48 with the magnetic shunt elements mounted on the opposing side walls of the carrier 49. The size of the shunts 22 and their magnetic permeability is selected to achieve the desired ballast operating and regulating characteristics, as is conventional. It should be understood that windings 14 and 24 can be assembled onto tube 48 separate from the ballast and thereafter the tube and the assembly of windings slid over the lamination stack.

A flat die-cut insulating piece 50 is slid over the tube 48 to provide positive insulation between the primary coil and the other coils. This insulating piece 50, which can be of plastic or paper, is designed to hug the center arm T laminations 44 and to fill the window of the laminations and to protrude past the ends of the windings to provide a barrier between windings.

The primary winding 12 is assembled on an insulating tube 52 which is fitted over the center arm 44 of the T laminations. Here also, the assembly of the winding onto the tube can be done separate from the ballast.

Two stacks of L-shaped laminations 58, one on each side of the T stack, are welded to the T head arms 42. The stacks of T and L laminations are fastened together by welding. Mechanical fasteners, such as bolts, are shown at the points 60 for holding the lamination stacks together. Wedges 59 can be located between the laminations and the windings to take up unused space and for noise dampening purposes.

The assembled ballast unit is dipped and baked in an approved varnish material and is tested as needed. The lead wires 36 which come from each of the windings 12, 24 and 14, are connected together in any of the configurations which are shown in FIGS. 4–10. If a capacitor and/or starter (not shown) is to be used, it can be located in a housing within which the ballast is located or adjacent to such housing.

Figure 3:
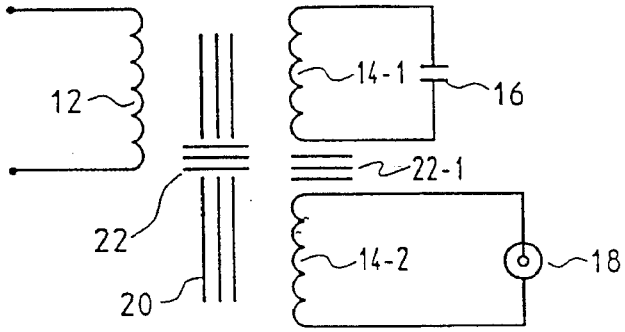
Fig. 3 PRIOR ART

The ballast according to the invention has a number of advantages with respect to ease of manufacture and costs. In a conventional CWA ballast, such as shown in FIG. 1, part of the primary voltage, anywhere from 30 to 240 volts, as induced in the auxiliary winding, is coupled directly to the secondary. This reduces the overall number of turns of the coil required for the secondary winding. That is, the voltage which is to be magnetically induced from the primary to the secondary winding is decreased so that the coil turns ratio between primary and secondary can be reduced. A coupling coefficient for a regulating CWA or CWI ballast with isolated primary and secondary windings with slots in them, such as shown in FIGS. 2 and 3, requires 1.6 to 1.8 times the normal turns ratio relationship for the secondary winding over a standard CWA transformer design, such as shown in FIG. 1. Because of this relationship, it becomes advantageous to obtain as much voltage from the primary side of the ballast shunts as is permissible for proper regulation. This reduces the number of turns required for the secondary winding.

The HID ballast design of the present invention provides isolation between the primary and secondary windings of a lamp ballast circuit while providing for all of the following advantages:

1. The smallest size unit for a given temperature rise.
2. The most efficient, lowest watts loss and coolest running, design for a given size.
3. The lowest material cost unit for a given power level and temperature index.
4. The ability to maintain the same capacitor value while still maintaining the same physical lamination dimensions, ex. no need to change slot configuration for a given lamination if a given capacitor value is to be maintained.

I claim:

1. An isolated constant wattage autotransformer ballast for an HID lamp comprising:

a primary winding for connection to a source voltage, a secondary winding, means for magnetically coupling said primary winding to said secondary winding to induce a voltage into said secondary winding from said primary winding, said primary and secondary windings being electrically isolated, an auxiliary winding electrically isolated from said primary winding and positioned with respect to said magnetic coupling means to be closely coupled to said primary winding so as to induce a voltage from said primary winding to said auxiliary winding, and means for electrically connecting one end of said auxiliary winding to one end of said secondary winding to add the voltage induced in said auxiliary winding from said primary winding to the voltage induced in said secondary winding from said primary winding, the additive voltage of said auxiliary winding and said secondary winding present between the other ends of said auxiliary and secondary windings being available to operate the HID lamp.

2. A ballast transformer as in claim 1 wherein said means for magnetic coupling further comprises magnetic shunt means between said primary and secondary windings, said auxiliary winding being positioned for close coupling to said primary winding on the primary winding side of said shunt means.

3. A ballast transformer as in claim 1 wherein said electrical connecting means includes a capacitor electrically connected in series with said electrically connected auxiliary and secondary winding ends.

4. A ballast transformer as in claim 1 further comprising a capacitor electrically connected to the other end of one of said electrically connected secondary and auxiliary windings.

5. A ballast as in claim 1 further comprising starter means electrically connected between the other ends of said auxiliary and secondary windings and an intermediate point of said secondary winding.

6. A ballast as in claim 3 further comprising starter means electrically connected between the other ends of said auxiliary and secondary windings and an intermediate point of said secondary winding.

7. A ballast as in claim 4 further comprising starter means electrically connected between the other ends of said auxiliary and secondary windings and an intermediate point of said secondary winding.

8. A ballast transformer as in claim 1 wherein said means for magnetically coupling comprises a stack of laminations with an elongated leg, each of said primary, secondary and auxiliary windings formed as a coil having a central opening into which said elongated leg fits, said auxiliary being winding positioned on said elongated leg closer to said primary winding than said secondary winding.

9. A ballast transformer as in claim 8 wherein said primary and auxiliary windings are adjacent to each other on said leg of said means for magnetically coupling.

10. A ballast transformer as in claim 9 wherein said means for magnetically coupling further comprises magnetic shunt means between said primary and second windings, said auxiliary winding being positioned on the primary winding side of said magnetic shunt means and wherein said magnetic shunt means is located between said secondary winding and said adjacent primary and auxiliary windings.

11. A ballast transformer as in claim 10 wherein the order of location of said windings along said elongated leg of said means for magnetically coupling is secondary winding, magnetic shunt means, primary winding and auxiliary winding.

12. A ballast transformer as in claim 8 wherein said stack of laminations includes a T with its central leg forming the elongated leg on which the windings are placed, and an L with the end of its leg arm adjacent the head leg of the T and the end of the long arm of each L facing each other.

13. A ballast transformer as in claim 1 wherein said primary winding magnetically couples its voltage to said auxiliary winding in substantially a 1:1 ratio.

14. A ballast transformer as in claim 12 wherein said means for magnetically coupling further comprises magnetic shunt means between said primary and secondary windings, said auxiliary winding being positioned on the primary winding side of said shunt means, and wherein said secondary winding, shunt means and primary winding are on a tube of insulating material which is fitted over said T lamination center arm.

15. A ballast transformer as in claim 14 wherein said auxiliary winding is on a tube of insulating material which is fitted over said T lamination center arm.

16. A ballast transformer as in claim 1 further comprising an HID lamp connected between the other ends of said auxiliary and secondary windings.

* * * * *